United States Patent [19]

Tamplen et al.

[11] Patent Number: 4,479,539

[45] Date of Patent: Oct. 30, 1984

[54] DOWNHOLE LOCK SYSTEM

[75] Inventors: Jack W. Tamplen, Celina; Carter R. Young, Argyle, both of Tex.

[73] Assignee: Otis Engineering Corporation, Dallas, Tex.

[21] Appl. No.: 434,723

[22] Filed: Oct. 18, 1982

[51] Int. Cl.[3] ..... E21B 23/04

[52] U.S. Cl. ..... 166/212; 166/217; 166/237

[58] Field of Search ..... 166/212, 217, 120, 125, 166/237

[56] References Cited

U.S. PATENT DOCUMENTS

| | | | |
|---|---|---|---|
| 3,002,565 | 10/1961 | Moore | 166/217 |
| 3,079,996 | 3/1963 | Tamplen | 166/115 |
| 3,100,532 | 8/1963 | Tamplen | 166/125 |
| 3,100,536 | 8/1963 | Tamplen | 166/185 |
| 3,130,788 | 4/1964 | Cochran et al. | 166/237 |
| 3,207,222 | 9/1965 | Tamplen | 166/136 |
| 3,208,531 | 9/1965 | Tamplen | 166/125 |
| 3,233,675 | 2/1966 | Tamplen et al. | 166/120 |
| 3,288,219 | 11/1966 | Young et al. | 166/210 |
| 3,507,329 | 4/1970 | Stone | 166/217 |
| 3,703,193 | 11/1972 | Raulins | 137/630 |
| 3,856,081 | 12/1974 | Canalizo | 166/217 |
| 4,161,984 | 7/1979 | Watkins | 166/217 |
| 4,345,649 | 8/1982 | Baugh et al. | 166/120 |

*Primary Examiner*—Stephen J. Novosad
*Assistant Examiner*—Mark J. Del Signore
*Attorney, Agent, or Firm*—Thomas R. Felger

[57] ABSTRACT

A system for releasably anchoring well tools within a tubing string at a preselected downhole location. The system includes a running tool, locking mandrel, and landing nipple. Control fluid pressure is used to ensure positive engagement of the locking mandrel within the landing nipple prior to releasing the running tool from the locking mandrel. The locking mandrel and running tool are particularly useful for installation of surface controlled subsurface safety valves. However, the system can be used to install a wide variety of flow control devices and/or well tools.

18 Claims, 12 Drawing Figures

DOWNHOLE LOCK SYSTEM

BACKGROUND OF THE INVENTION

1. Field of the Invention

The present invention relates to locking mandrels and systems for installing flow control devices downhole in a well bore. The locking mandrel of the present system is particularly useful for releasably installing surface controlled subsurface safety valves within a landing nipple at a downhole location.

2. Description of the Prior Art

A wide variety of running tools, locking mandrels and landing nipples have been developed for installation and removal of flow control devices from downhole locations within a well bore. Examples of such devices are shown in U.S. Pat. No. 3,079,996 "Flow Control Devices for Flow Conductors"; U.S. Pat. No. 3,100,532 "Well Tools for Plugging a Well Flow Conductor"; U.S. Pat. No. 3,100,536 "Anchoring and Sealing Devices"; U.S. Pat. No. 3,207,222 "Locking Device and Running Tool Therefor"; and U.S. Pat. No. 3,208,531 "Inserting Tool for Locating and Anchoring a Device in Tubing". One limitation of each of the preceding devices is that they do not provide positive indication that the flow control device has in fact been secured or anchored at the desired downhole location. This limitation is of particular concern if the tubing string has several collar recesses and/or landing nipple profiles which can be engaged by the locking mandrel.

The present invention provides positive indication that the locking mandrel is anchored at a specific location within the tubing string. Control fluid pressure from the well surface which normally operates the subsurface flow control device is used to disengage the running tool from the locking mandrel after the locking mandrel is anchored at the desired downhole location. The above listed patents are incorporated by reference for all purposes within this application.

SUMMARY OF THE INVENTION

The present invention discloses a system for securing a flow control device at a preselected downhole location within a well flow conductor comprising a landing nipple with a bore therethrough attached to the flow conductor at the downhole location; a control fluid conduit extending from the landing nipple to the well surface; a locking groove formed within the bore; a passageway communicating control fluid between the bore and the conduit; a locking mandrel having a tubular housing means with a longitudinal passageway extending therethrough; a plurality of windows extending radially through the housing means intermediate the ends thereof; a locking dog disposed within each window and radially slidable relative to the housing means; the dogs selected to be received within the locking groove; an expander sleeve slidably disposed within the longitudinal passageway adjacent to the locking dogs; the expander sleeve having three positions, the first position allowing retraction of each dog within its respective window, the second position projecting a portion of each dog radially from its window, and the third position allowing retraction of each dog within its window; piston means slidably disposed within the longitudinal passageway and operatively engaging the expander sleeve; and means for communicating fluid pressure from the control fluid conduit to the piston means whereby the piston means can shift the expander sleeve from its first to its second position.

One object of the present invention is to provide a locking mandrel which can be released from its associated running tool only after fluid pressure above a preselected value has been applied to the locking mandrel.

Another object of the present invention is to provide a locking mandrel which is engaged with its associated landing nipple by control fluid pressure exceeding a preselected value. After such engagement, the locking mandrel remains anchored within the landing nipple without regard to fluctuations in control fluid pressure.

A further object of the present invention is to provide a system for anchoring a well tool at a preselected downhole location and providing positive assurance that the well tool is anchored at the desired location.

An additional object of the present invention is to provide a running tool which cannot be released from its associated locking mandrel until after packing means carried on the exterior of the locking mandrel has formed a fluid barrier with the interior of a preselected landing nipple and the locking mandrel is anchored within this same landing nipple.

Additional objects and advantages will be readily apparent to those skilled in the art after reading and studying the following written description in conjunction with the drawings and claims.

DESCRIPTION OF THE PREFERRED EMBODIMENTS

Figure 1:
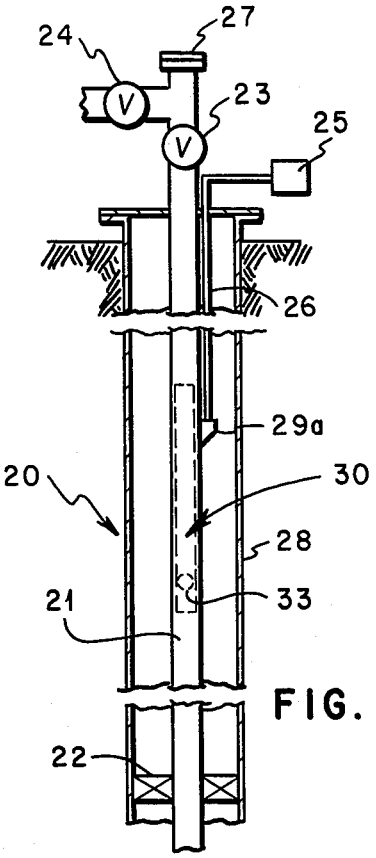
FIG. 1 is a schematic drawing of a typical well completion having a retrievable surface controlled subsurface safety valve installed within a well flow conductor.

A typical well completion 20 is shown in FIG. 1. The well bore is defined by casing string 28 which extends from the well surface to the hydrocarbon producing formation (not shown). Tubing or well flow conductor 21 is disposed within casing string 28. Production packer 22 directs formation fluid which enters casing 28 to the well surface via tubing 21. Valves 23 and 24 control fluid flow from tubing 21 at the well surface.

Cap or flange cover 27 is provided at the well surface to allow servicing of well 20 by conventional wireline techniques. Such servicing includes the installation and removal of flow control devices from within tubing 21. One type of flow control device frequently used in high pressure flowing wells is surface controlled subsurface safety valve 30. Safety valve landing nipple 29 shown in FIGS. 5A and B comprises an integral part of tubing 21. Control line or conduit 26 extends from hydraulic manifold 25 at the well surface to landing nipple 29 at the preselected downhole location. Boss 29*a* is used to attach control line 26 to landing nipple 29 and to communicate control fluid between the interior of landing nipple 29 and control line 26. Hydraulic manifold 25 at the well surface includes the pumps, reservoir, accumulators and control valves normally associated with a surface controlled subsurface safety valve. U.S. Pat. No. 3,703,193 discloses one type of retrievable subsurface safety valve which can be used with the present invention. However, the present invention can be used to install any type of flow control device and/or well tool within a landing nipple as long as control fluid pressure is available at the landing nipple.

Figure 2A:
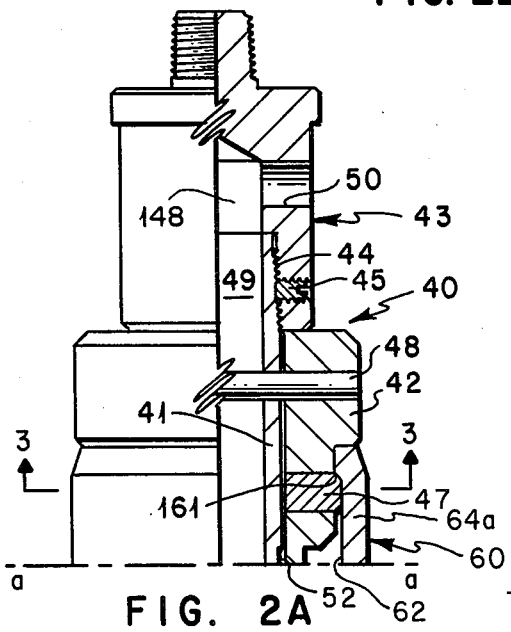
FIGS. 2A, 2B and 2C are drawings, in elevation and longitudinal section with portions broken away, showing a running tool releasably engaged to a locking mandrel with a flow control device (surface controlled subsurface safety valve) attached thereto.

FIGS. 2A, B, and C show running tool 40, locking mandrel 60 and safety valve 30 attached to each other prior to installation within well flow conductor 21. Running tool 40 is used to releasably secure locking mandrel 60 at a preselected location in flow conductor 21 defined by landing nipple 29. Running tool 40 comprises inner sleeve 41 concentrically disposed within outer sleeve 42. Fishing neck 43 is attached by threads 44 and set screw 45 to one end of inner sleeve 41 which extends from outer sleeve 42. Fishing neck 43 provides means for attaching inner sleeve 41 and thus running tool 40 to a wireline tool string.

Figure 2B:
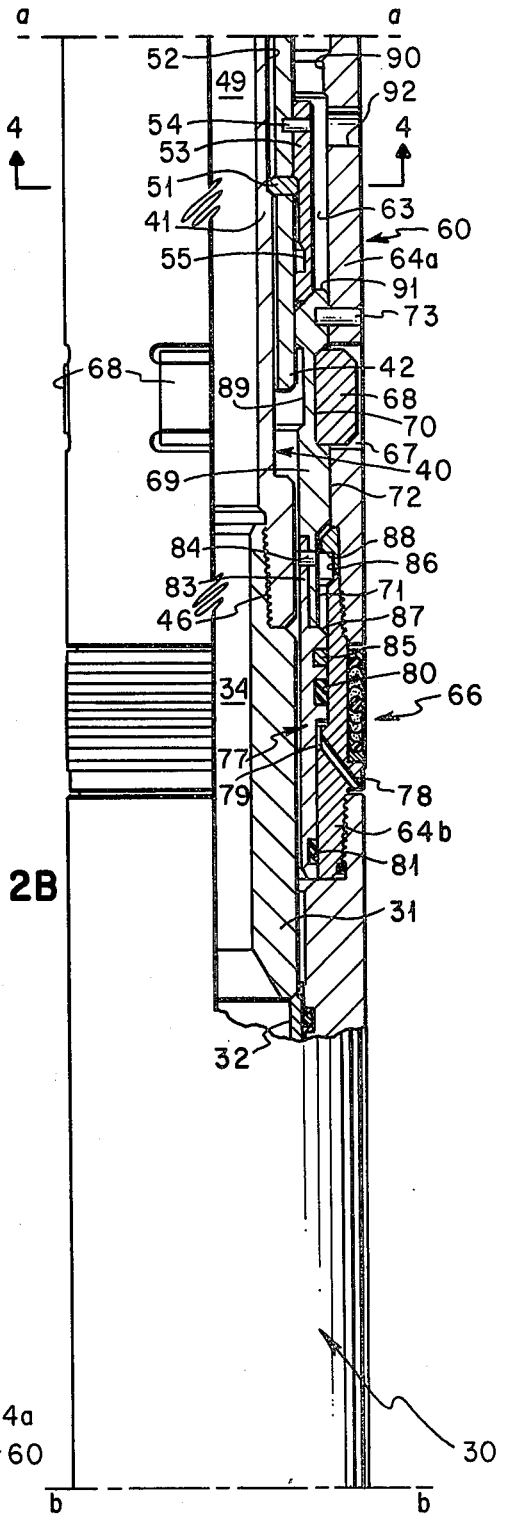
Figure 2C:
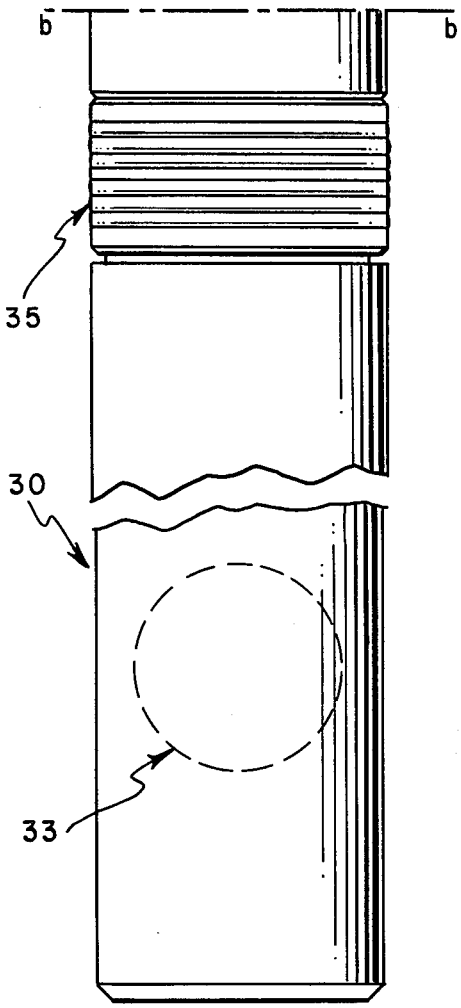
Figure 4:
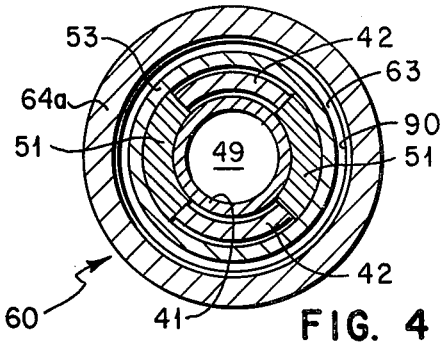
FIG. 4 is a drawing in horizontal section taken along line 4—4 of FIG. 2B.
Figure 3:
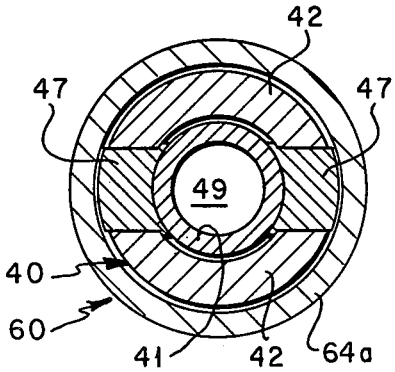
FIG. 3 is a drawing in horizontal section taken along line 3—3 of FIG. 2A.

Opening prong 31 is attached by threads 46 to the opposite end of inner sleeve 41 which extends from outer sleeve 42. As shown in FIG. 2B, prong 31 abuts operating tube 32 which in turn holds ball valve member 33 in its open position. Various alternative configurations of fishing neck 43 and prong 31 can be satisfactorily used with running tool 40. The only requirement is that running tool 40 be securely attached to the wireline tool string and safety valve 30 held in its open position to allow installation within landing nipple 29. Some flow control devices such as downhole chokes do not require a separate equalizing device. In such a case, prong 31 could be eliminated from running tool 40. The primary design requirement for the present invention is that inner sleeve 41 and outer sleeve 42 must be able to slide longitudinally relative to each other during the installation of locking mandrel 60 within landing nipple 29.

Outer sleeve 42 carries a first set of lugs 47 which are projected radially outward by contact with the exterior of inner sleeve 41. Lugs 47 are sized to engage shoulder 161 formed by recess 62 within locking mandrel 60. As will be explained later, running tool 40 is sized to fit within longitudinal passageway 63 which extends through locking mandrel 60. As best shown in FIG. 2A, lugs 47 are used to releasably secure running tool 40 within locking mandrel 60. Shear pin 48 extends through inner sleeve 41 and outer sleeve 42, preventing undesired relative movement therebetween. As long as shear pin 48 remains intact, inner sleeve 41 holds first lugs 47 projected radially from outer sleeve 42.

Bore 148 extends partially through the longitudinal axis of fishing neck 43. Lateral ports 50 intersect bore 148 intermediate the ends thereof. Inner sleeve 41 has bore 49 extending longitudinally therethrough. Bores 148 and 49 are aligned with each other to allow fluid communication therebetween. Prong 31 also has bore 34 extending longitudinally therethrough. Bore 34 communicates fluid with bore 49. Thus, well fluid pressures can be equalized through open ball valve member 33, bores 34, 49, 148, and lateral ports 50 while installing locking mandrel 60 into landing nipple 29. Running tool 40 could be modified by manufacturing inner sleeve 41 from a solid piece of metal and eliminating bore 49 if the previously described equalization flow path is not required. If inner sleeve 41 is manufactured from a solid workpiece, it would be more appropriately defined as the "inner core" of running tool 40.

Outer sleeve 42 carries a second set of lugs 51 which can be projected radially inward to releasably secure outer sleeve 42 to inner sleeve 41. Inner sleeve 41 has a reduced outside diameter portion 52 which receives lugs 51 when they are projected radially inward. Reduced outside diameter portion 52 is an important feature for satisfactory operation of running tool 40.

Locking cylinder 53 is releasably secured to the exterior of outer sleeve 42. Shear pin 54 holds locking cylinder 53 in its first position. When locking cylinder 53 is in its first posiiton as shown in FIG. 2B, the inside diameter of locking cylinder 53 holds lugs 51 projected radially inward and engaged with reduced outside diameter portion 52. Thus, locking cylinder 53 and lugs 51 cooperate to prevent undesired longitudinal movement of inner sleeve 41 relative to outer sleeve 42 while locking cylinder 53 is in its first position.

Figure 6A:
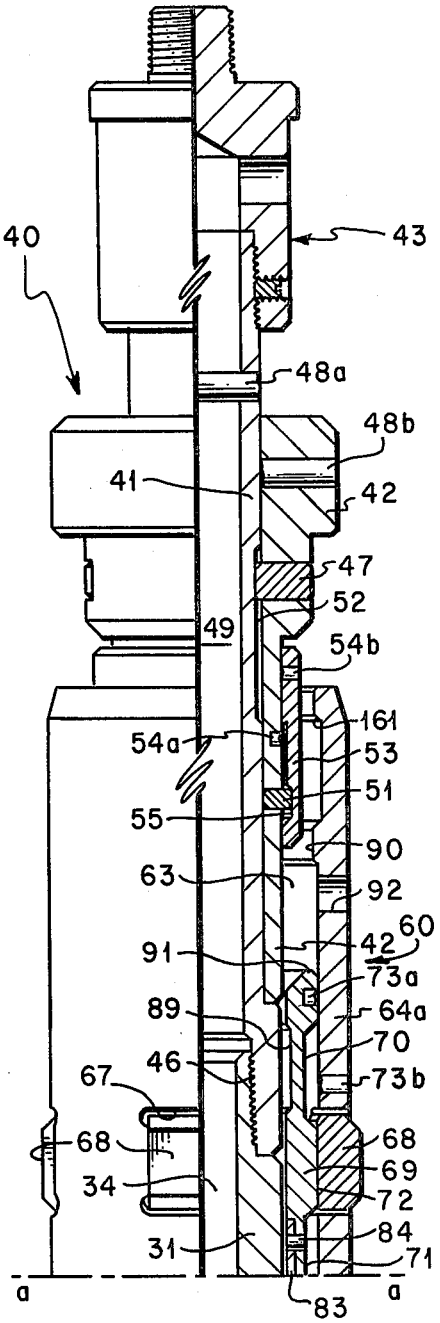
FIGS. 6A and 6B are drawings, in elevation and longitudinal section with portions broken away, showing the running tool being withdrawn from the locking mandrel.
Figure 6B:
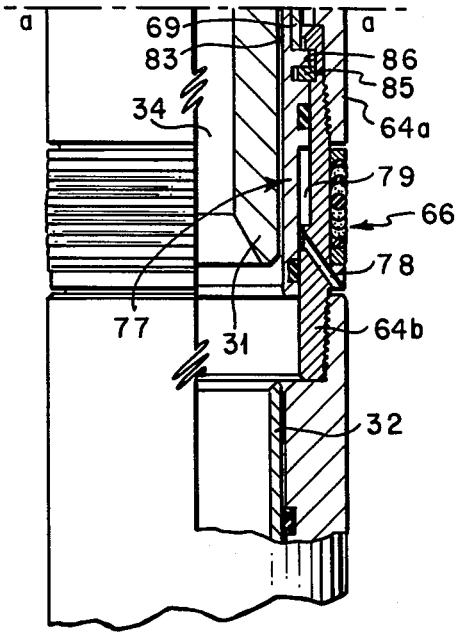

Locking cylinder 53 has annular groove 55 formed on its inside diameter spaced longitudinally from shear pin 54. Groove 55 is sized to receive lugs 51 therein. As will be explained later, sufficient force can be applied to locking cylinder 53 to cause pin 54 to shear and to slide locking cylinder 53 longitudinally to its second position as shown in FIG. 6A. In its second position, annular groove 55 is located adjacent to the second set of lugs 51. Thus, lugs 51 can move radially outward, releasing or retracting their engagement between inner sleeve 41 and outer sleeve 42.

Locking mandrel 60 comprises a tubular housing means 64 with longitudinal passageway 63 extending therethrough. For ease of manufacture and assembly, housing means 64 has two subassemblies 64*a* and 64*b* which are concentrically connected to each other by threads 65. Threads 82 on the extreme end of subassembly 64*b* provide means for attaching a flow control device to tubular housing means 64. Packing means 66 are carried on the exterior tubular housing means subassembly 64*b*. A similar set of packing means 35 is carried on the exterior of safety valve 30. Packing means 66 and 35 are spaced longitudinally from each other. Both packing means 66 and 35 are selected to form a fluid tight barrier with the adjacent inside diameter of landing nipple 29 as locking mandrel 60 is secured therein.

Figure 5A:
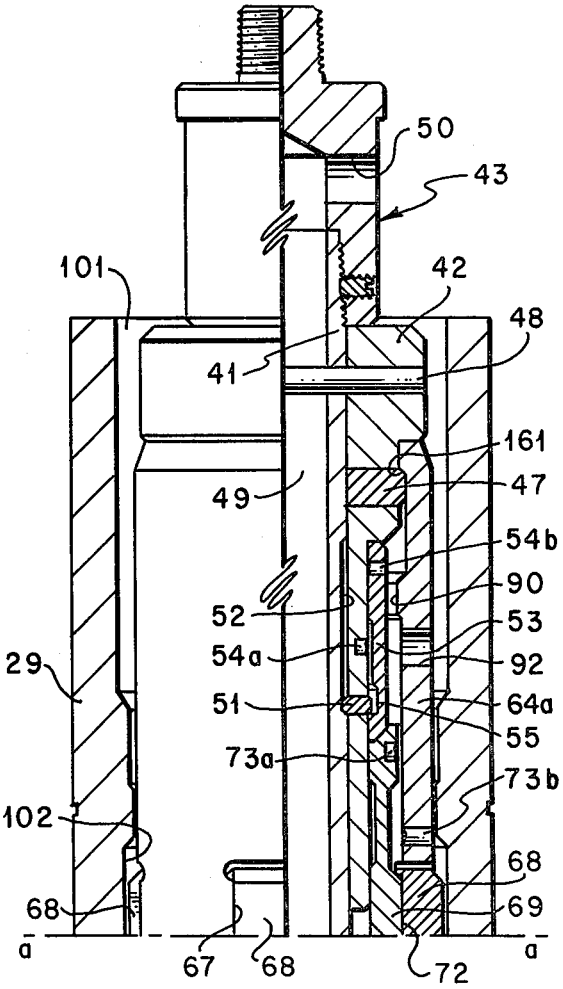
FIGS. 5A and 5B are drawings, in elevation and longitudinal section with portions broken away, showing the running tool, locking mandrel and flow control device of FIGS. 2A–2C at the preselected downhole location with the well flow conductor. The drawings show the configuration of the locking mandrel and running tool after control fluid pressure shifts the expander sleeve to its second position.
Figure 7:
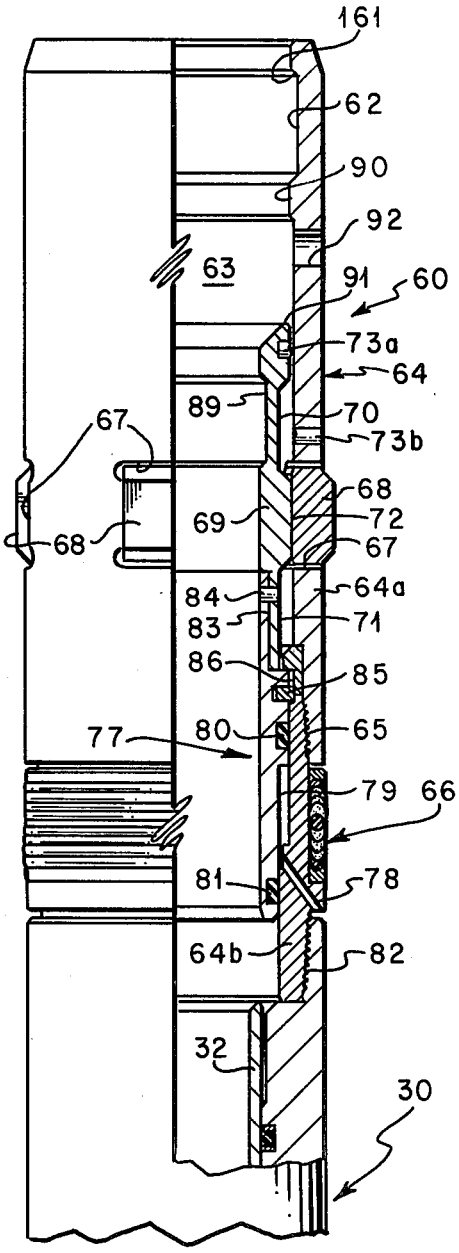
FIG. 7 is a drawing, in elevation and longitudinal section with portions broken away, showing the locking mandrel in its set position.
Figure 8:
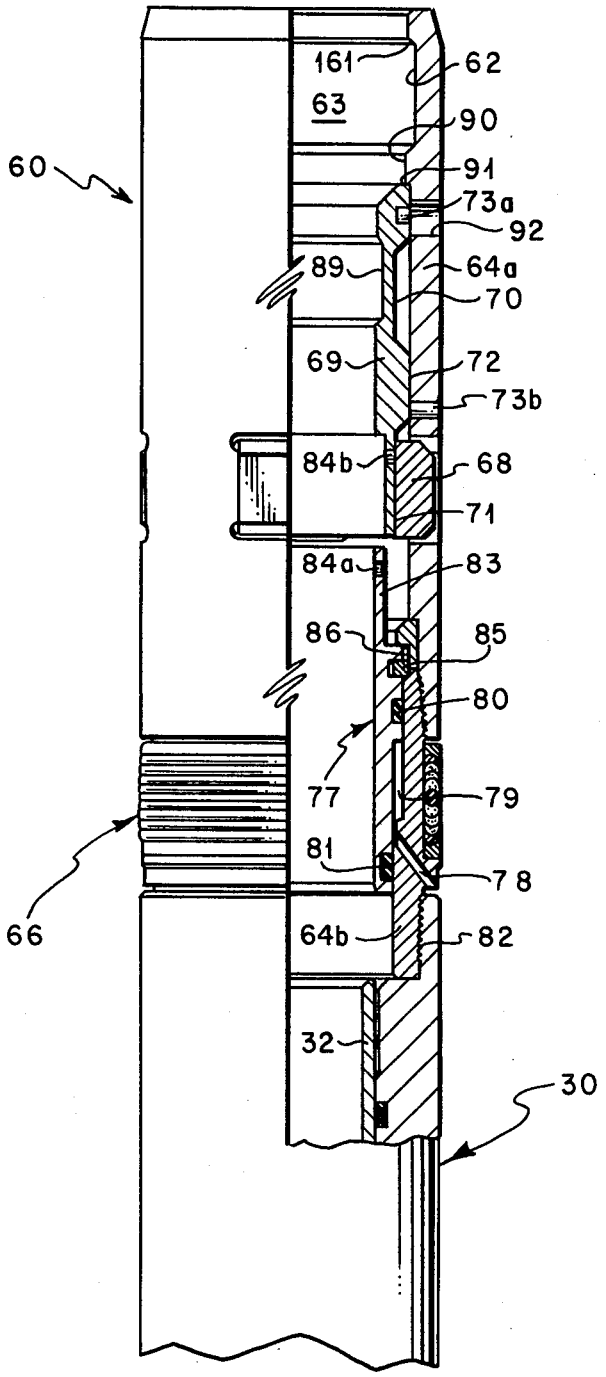
FIG. 8 is a drawing, in elevation and longitudinal section with portions broken away, showing the locking mandrel in its released position.

A plurality of windows 67 extends radially through housing means 64 intermediate the ends thereof. A locking dog 68 is disposed within each window 67 and sized to be radially slidable relative to housing means 64. Expander sleeve 69 is slidably disposed within longitudinal passageway 63 adjacent to locking dogs 68. Large annular recesses 70 and 71 are formed on the exterior of expander sleeve 69. Each recess 70 and 71 is sized to receive dogs 68 therein. Recesses 70 and 71 are spaced longitudinally from each other, producing land or flange 72 therebetween. The dimensions for recesses 70 and 71, dogs 68 and windows 67 are selected such that dogs 68 do not project radially from housing means 64 when they are disposed within either recess 70 or 71. The outside diameter of flange 72 is selected to be slidable within longitudinal passageway 63 and to radially project a portion of dogs 68 from windows 67 when flange 72 is positioned radially adjacent to dogs 68. Thus, expander sleeve 69 has three distinct positions. The first position allows retraction of dogs 68 into recess 70 as shown in FIG. 2B. Shear pin 73 provides means for releasably securing expander sleeve 69 in its first position. In the second position, flange 72 projects a portion of each dog 68 radially from its respective window 67 as shown in FIGS. 5A and 7. The third position of expander sleeve 69 allows retraction of dogs 68 into recess 71 as shown in FIG. 8.

Piston means 77 is slidably disposed within longitudinal passageway 63 and operatively engaged with expander sleeve 69. Piston 77 can be described generally as a hollow cylinder. Seal means 80 and 81 are carried on the outside diameter of piston means 77 and form a fluid barrier with the adjacent inside diameter of housing means 64. Variable volume fluid chamber 79 is partially defined by seal means 80 and 81. The effective area of seal means 80 is larger than the effective area of seal means 81. Thus, increasing fluid pressure within variable volume fluid chamber 79 above fluid pressure within longitudinal passageway 63 tends to shift piston means 77 in one direction. Since piston means 77 abuts expander sleeve 69, shear pin 73 opposes movement of piston means 77. Thus, piston means 77 provides the force required to shear pin 73 and to shift expander sleeve 69 from its first to its second position. If desired, shear pin 73 could be installed to releasably secure piston means 77 directly to housing means subassembly **64*b*. This configuration would also releasably secure expander sleeve 69** in its first position.

Port means 78 extends through housing means 64 to provide fluid communication with variable volume fluid chamber 79. The opening for port means 78 on the exterior of housing means 64 is positioned to be between packing means 66 and 35. Thus, port means 78 is a portion of the means for communicating fluid pressure to piston means 77 whereby piston means 77 can shift expander sleeve 69 from its first to its second position.

Piston means 77 is telescoped partially into expander sleeve 69. The end portion of piston means 77 within expander sleeve 69 is designated 83. Shear pin 84 extends through the overlapping portions of piston means 77 (end 83) and expander sleeve 69. Piston means 77 also carries snap ring 85 on its exterior between end 83 and seal means 80. Recess 86 is formed on the inside diameter of housing means 64 and sized to receive snap ring 85 therein. The location of recess 86 is selected such that snap ring 85 will become engaged therein after piston means 77 has shifted expander sleeve 69 to its second position. Engagement of snap ring 85 with recess 86 cooperates to prevent longitudinal movement of piston means 77 without regard to fluid pressure in variable volume chamber 79. Piston means 77 also has an upwardly facing shoulder 87 which contacts downwardly facing shoulder 88 when snap ring 85 is engaged in recess 86. Downwardly facing shoulder 88 is secured to the interior of housing means 64 and projects radially inward to provide a positive stop for piston means 77. Shoulders 87 and 88 cooperate to ensure that piston means 77 cannot shift expander sleeve 69 beyond its second position. Shoulders 87 and 88 along with snap ring 85 and recess 86 also cooperate to provide a portion of the means for releasably securing expander sleeve 69 in its second position.

Profile or recess 89 is formed on the inside diameter of expander sleeve 69. Profile 89 is selected to receive a conventional wireline pulling tool (not shown). When shoulders 87 and 88 are in contact, shear pin 84 prevents further movement of expander sleeve 69. By engaging profile 89 with a pulling tool, force can be applied to break shear pin 84 and to allow movement of expander sleeve 69 from its second to its third position.

Flange 90 is formed on the inside diameter of housing means 64 and projects radially inward. Flange 90 partially defines recess 62 which is engaged by the first set of lugs 47 on running tool 40. In addition, flange 90 restricts the inside diameter of longitudinal passageway 63 such that expander sleeve 69 cannot slide therepast. Thus, when expander sleeve 69 is shifted to its third position, end 91 contacts flange 90 limiting the longitudinal movement of expander sleeve 69 in the one direction as shown in FIG. 8. The location of flange 90 and dogs 68 is selected such that when end 91 of expander sleeve 69 contacts flange 90, recess 71 is radially adjacent to dogs 68 allowing their retraction. After dogs 68 are retracted, the weight of locking mandrel 60 and safety valve 30 is transferred to the wireline tool engaged with profile 89 via flange 90 and end 91. Thus, flange 90, end 91, profile 89, and recess 71 cooperate to provide means for removing locking mandrel 60 from its downhole location after expander sleeve 69 has been shifted to its third position. Opening 92 extends radially through housing means 64 above packing means 66 to equalize fluid pressure between longitudinal passageway 63 and the exterior of housing means 64. Such equalization is particularly helpful during removal of locking mandrel 60.

Figure 5B:
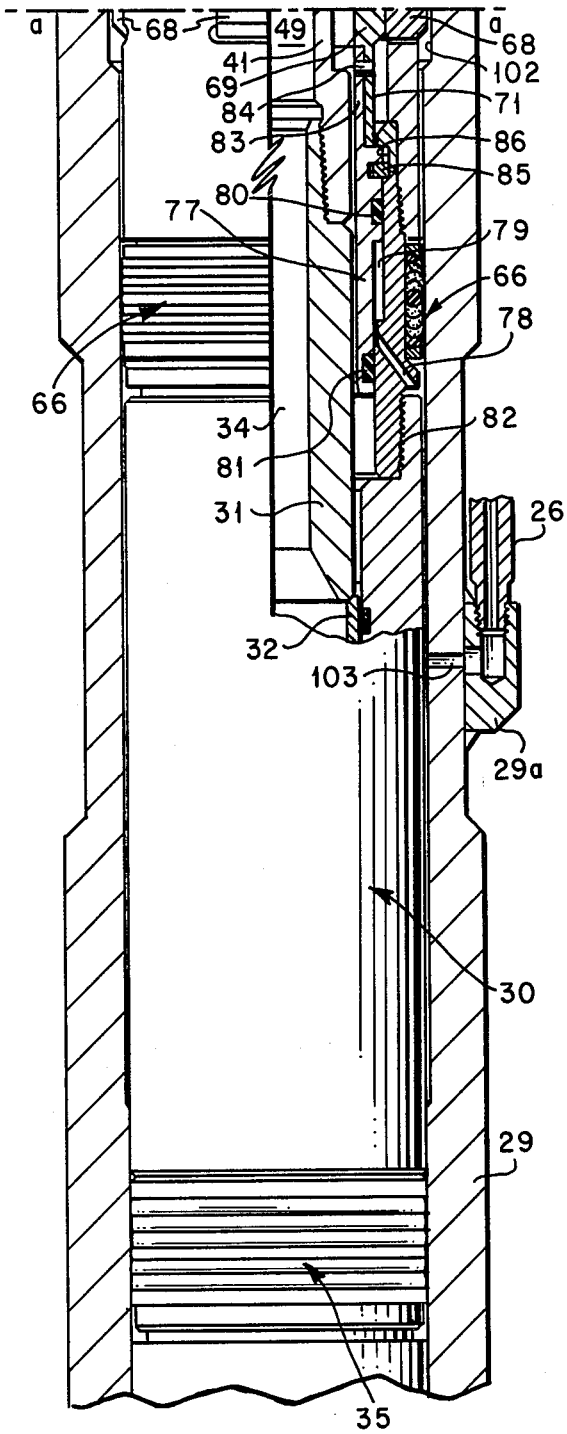

Landing nipple 29 shown in FIGS. 5A and 5B is made up as an integral part of tubing string 21 by conventional threads and/or couplings (not shown). Bore 101 extends through landing nipple 29 and is sized to receive locking mandrel 60 therein. Locking groove 102 is formed on the inside diameter of landing nipple 29. Locking groove 102 and dogs 68 are selected to be compatible with each other. Various combinations of dogs 68 and locking grooves 102 which are well known in the art could be used in this downhole locking system. Passageway 103 extends radially through the exterior of landing nipple 29 and boss **29*a* to communicate control fluid pressure between control line 26 and bore 101. The longitudinal spacing between locking groove 102 and passageway 103 is selected with reference to the longitudinal spacing of dogs 68 and packing means 66 and 35 so that when dogs 68 are engaged in locking groove 102, packing means 66 and 35 will straddle passageway 103**.

Operating Sequence

Running tool 40, locking mandrel 60, and surface controlled subsurface safety valve 30 are assembled at the well surface as shown in FIGS. 2A, B, and C. Fishing neck 43 is then attached to a conventional wireline tool string (not shown) including a rope socket, sinker bar, and mechanical jars. The tool string and attached components are lowered by conventional wireline techniques through tubing 21 to the preselected downhole location defined by landing nipple 29.

The weight of locking mandrel 60 and safety valve 30 is supported by the wireline via shoulder 161, first set of lugs 47, outer sleeve 42, shear pin 48, inner sleeve 41 and fishing neck 43. The engagement of the second set of lugs 51 with reduced outside diameter portion 52 prevents upward shearing forces from being applied to pin 48 while lowering the tool string. Locking cylinder 53 is held in its first position by shear pin 54 to prevent premature release of second set of lugs 51 from inner sleeve 41.

When locking mandrel 60 is properly positioned within landing nipple 29 as shown in FIGS. 5A and 5B, packing means 66 and 35 form fluid barriers on opposite sides of passageway 103. Packing means 66 and 35 cooperate to direct control fluid pressure from conduit 26 to variable volume chamber 79 via port means 78. Shear pin 73 maintains expander sleeve 69 in its first position until the fluid pressure applied to piston means 77 exceeds a preselected value. FIG. 5A shows shear pin 73 broken into two portions **73*a* and 73*b* which allows expander sleeve 69 to move longitudinally in one direction to its second position radially expanding dogs 68 into locking groove 102 of nipple 29. Since locking cylinder 53 abuts expander sleeve 69, the same longitudinal movement of expander sleeve 69 also shears pin 54 and shifts locking cylinder 53 to its second position. See FIG. 5A. By applying upward jarring force to fishing neck 43, second set of lugs 51 can be cammed outwardly into groove 55. At this time, only shear pin 48 resists upward shearing forces when locking cylinder 53 is in its second position. Outer sleeve 42 is prevented from moving upward by engagement between first set of lugs 47, shoulder 161, dogs 68, and locking groove 102. Thus, sufficient upward jarring force will shear pin 48 into two portions 48*a* and 48*b* and slide inner sleeve 41 longitudinally upward relative to outer sleeve 42. This longitudinal movement positions reduced outside diameter portion 52 radially adjacent to first set of lugs 47. Shoulder 161 and lugs 47 have appropriate camming surfaces to force lugs 47 radially inward and release running tool 40 from locking mandrel 60 as shown in FIG. 6A. Expander sleeve 69 is releasably secured in its second position projecting dogs 68** radially outward.

If locking mandrel 60 was not properly positioned within nipple 29, fluid pressure could not be applied to variable volume chamber 79. Expander sleeve 69 cannot move to its second position unless dogs 68 are free to move radially outward into locking groove 102. Finally, locking cylinder 53 can only be shifted to its second position allowing release of running tool 40 from locking mandrel 60 by movement of expander sleeve 69 to its second position. The above sequence provides positive assurance at the well surface that locking mandrel 60 is anchored within landing nipple 29.

Locking mandrel 60 is released from landing nipple 29 by engaging profile 89 of expander sleeve 69 with an appropriately sized wireline pulling tool. Upward jarring forces can be applied to expander sleeve 69 by conventional wireline techniques which cause pin 84 to separate into two portions **84*a* and 84*b*. This upward shearing force releases expander sleeve 69 from piston means 77 which previously held expander sleeve 69 in its second position. Expander sleeve 69 is then free to slide longitudinally to its third position in which recess 71 is positioned radially adjacent to dogs 68, and end 91 contacts flange 90. Dogs 68 and locking groove 102 have appropriate camming surfaces which cause dogs 68 to be retracted radially inward. See FIG. 8. Locking mandrel 60 and any well tool attached to threads 82 can be retrieved from the downhole location by the pulling tool secured within profile 89**.

The previous written description describes the preferred embodiments of the present invention. Those skilled in the art will readily see alternative configurations and modifications without departing from the scope of the invention which is defined in the following claims.

What is claimed is:

1. A locking mandrel for releasably securing a flow conductor device at a downhole location within a well flow conductor, comprising:

a. a tubular housing means with a longitudinal passage extending therethrough;

b. a plurality of windows extending radially through the housing means intermediate the ends thereof;

c. a locking dog disposed within each window and radially slidable relative to the housing means;

d. an expander sleeve slidably disposed within the longitudinal passageway adjacent to the locking dogs;

e. the expander sleeve having three positions, the first position allowing retraction of the dogs within the windows, the second position projecting a portion of each dog radially from its respective window, and the third position allowing retraction of each dog within its window;

f. piston means slidably disposed within the longitudinal passageway and operatively engaging the expander sleeve;

g. means for communicating fluid pressure to the piston means whereby the piston means can shift the expander sleeve from its first to its second position;

h. means for releasably securing the expander sleeve in its first position until the fluid pressure applied to the piston means exceeds a preselected value;

i. a profile formed on the interior of the expander sleeve which can be mechanically engaged by a well tool to move the expander sleeve from its second to its third position; and j. means for removing the locking mandrel from its downhole location after the expander sleeve has been shifted to its third position.

2. A locking mandrel as defined in claim 1, further comprising means for attaching a flow control device to the tubular housing means.

3. A locking mandrel as defined in claim 1, further comprising:

a. means for preventing longitudinal movement of the piston means when the expander sleeve is in its second position; and b. means for releasably securing the expander sleeve in its second position.

4. A locking mandrel as defined in claim 3, wherein the piston means further comprises:

a. a hollow cylinder slidably disposed within the longitudinal passageway abutting the expander sleeve;

b. a snap ring carried on the exterior of the hollow cylinder and engageable within a recess in the inside diameter of the housing means; and c. the snap ring and recess cooperating to form a portion of the means for preventing longitudinal movement of the piston means when the expander sleeve is in its second position.

5. A locking mandrel as defined in claim 4, wherein the piston means further comprises:

a. one end of the hollow cylinder telescoped partially into the expander sleeve; and b. a shear pin extending between the telescoped portions of the hollow cylinder and the expander sleeve.

6. A locking mandrel as defined in claim 5, wherein the means for releasably securing the expander sleeve in its second position comprises:

a. the shear pin between the hollow cylinder and the expander sleeve;

b. the means for preventing longitudinal movement of the piston means when the expander sleeve is in its second position; and c. means for applying force to the expander sleeve to break the shear pin and allow movement of the expander sleeve from its second to its third position.

7. A locking mandrel as defined in claim 1, wherein the means for communicating fluid pressure to the piston means comprises:

a. port means extending radially through the tubular housing means adjacent to the piston means;

b. the port means communicating fluid pressure between the exterior of the tubular housing means and the piston means; and c. packing means carried on the exterior of the tubular housing means to direct fluid pressure into the port means.

8. A running tool for securing a locking mandrel, as defined in claim 1, at a preselected location within a well flow conductor, comrpising:

a. an inner sleeve concentrically disposed within an outer sleeve;

b. the outer sleeve carrying a first set of lugs which can be projected radially outward to engage the outer sleeve with the locking mandrel;

c. the outer sleeve carrying a second set of lugs which can be projected radially inward to releasably secure the outer sleeve to the inner sleeve;

d. a locking cylinder releasably secured to the exterior of the outer sleeve having a first position holding the second set of lugs engaged with the inner sleeve and a second position allowing disengagement of the second set of lugs from the inner sleeve; and e. the locking cylinder carried on the outer sleeve adjacent to the expander sleeve of the locking mandrel whereby movement of the expander sleeve from its first to its second position will shift the locking cylinder from its first to its second position.

9. A running tool as defined in claim 8, further comprising:

a. means for attaching the inner sleeve to a wireline tool string;

b. a shear pin extending through the inner and outer sleeves preventing relative movement therebetween;

c. the second set of lugs while engaged with the inner sleeve preventing shearing forces from being applied to the shear pin;

d. the exterior of the inner sleeve holding the first set of lugs engaged with the locking mandrel when the shear pin is installed; and e. a reduced outside diameter portion on the inner sleeve which can be positioned adjacent to the first set of lugs allowing retraction thereof after the shear pin has been sheared.

10. A running tool as defined in claim 9, further comprising:

a. the second set of lugs engaged with the reduced outside diameter portion of the inner sleeve when the locking cylinder is in its first position; and b. an annular groove formed on the inside diameter of the locking cylinder to receive the second set of lugs after the locking cylinder is shifted to its second position.

11. A running tool as defined in claim 9, further comprising means for attaching a prong to the inner sleeve which can hold open a flow control device attached to the lock mandrel.

12. A running tool for securing a locking mandrel at a preselected location within a well flow conductor, comprising:

a. an inner core concentrically disposed within an outer sleeve;

b. the outer sleeve carrying a first set of lugs which can be projected radially outward to engage the outer sleeve with the locking mandrel;

c. the outer sleeve carrying a second set of lugs which can be projected radially inward to releasably secure the outer sleeve to the inner core;

d. a locking cylinder releasably secured to the exterior of the outer sleeve having a first position holding the second set of lugs engaged with the inner core and a second position allowing disengagement of the second set of lugs from the inner core;

e. means for attaching the inner core to a wireline tool string;

f. a shear pin extending through the inner core and outer sleeve preventing relative movement therebetween;

g. engagement of the second set of lugs with the inner core preventing shearing forces from being applied to the shear pin;

h. the exterior of the inner core holding the first set of lugs engaged with the locking mandrel when the shear pin is installed; and i. a reduced outside diameter portion of the inner core allowing retraction of the first set of lugs after the shear pin has been sheared.

13. A running tool as defined in claim 12, further comprising:

a. the second set of lugs engaged with the reduced outside diameter portion of the inner core when the locking cylinder is in its first position; and b. an annular groove formed on the inside diameter of the locking cylinder to receive the second set of lugs after the locking cylinder is shifted to its second position.

14. A running tool as defined in claim 13, further comprising means for attaching a prong to the inner core which can hold open a flow control device.

15. A running tool as defined in claim 12, further comprising:

a. the second set of lugs comprising a first means for releasably securing the outer sleeve to the inner core;

b. second means for releasably securing the outer sleeve to the inner core;

c. disengagement of the second set of lugs from the inner core allowing force to be applied to disengage the second releasable securing means; and d. a reduced outside diameter portion on the inner core which can be positioned adjacent to the first set of lugs after disengagement of the second releasable means.

16. A system for securing a flow control device at a preselected downhole location within a well flow conductor, comprising:

a. a landing nipple with a bore therethrough attached to the flow conductor at the downhole location;

b. a control fluid conduit extending from the landing nipple to the well surface;

c. a locking groove formed within the bore;

d. a radial passageway communicating control fluid between the bore and the conduit;

e. a locking mandrel having a tubular housing means with a longitudinal passageway extending therethrough;

f. a plurality of windows extending radially through the housing means intermediate the ends thereof;

g. a locking dog disposed within each window and radially slidable relative to the housing means;

h. the dogs selected to be received within the locking groove;

i. an expander sleeve slidably disposed within the longitudinal passageway adjacent to the locking dogs;

j. the expander sleeve having three positions, the first position allowing retraction of each dog within its respective window, the second position projecting a portion of each dog radially from its window, and the third position allowing retraction of each dog within its window;

k. piston means slidably disposed within the longitudinal passageway and operatively engaging the expander sleeve; and l. means for communicating fluid pressure from the control fluid conduit to the piston means whereby the piston means can shift the expander sleeve from its first to its second position.

17. A system as defined in claim 16, including a running tool for securing the locking mandrel within the landing nipple which comprises:

a. an inner sleeve concentrically disposed within an outer sleeve;

b. the outer sleeve carrying a first set of lugs which can be projected radially outward to engage the outer sleeve with the locking mandrel;

c. the outer sleeve carrying a second set of lugs which can be projected radially inward to releasably secure the outer sleeve to the inner sleeve;

d. a locking cylinder releasably secured to the exterior of the outer sleeve having a first position holding the second set of lugs engaged with the inner sleeve and a second position allowing disengagement of the second set of lugs from the inner sleeve; and e. the locking cylinder carried on the outer sleeve adjacent to the expander sleeve of the locking mandrel whereby movement of the expander sleeve from its first to its second position will shift the locking cylinder from its first to its second position.

18. The system as defined in claim 16, wherein the means for communicating fluid pressure to the piston means comprises:

a. a port means extending through the tubular housing means adjacent to the piston means;

b. packing means carried on the exterior of the locking mandrel and the flow control device spaced longitudinally from each other on opposite sides of the port means; and c. the radial passageway in the landing nipple located between the fluid seals formed by the packing means and the bore of the landing nipple.

* * * * *